US006869271B2

(12) United States Patent
Gilbert et al.

(10) Patent No.: US 6,869,271 B2
(45) Date of Patent: Mar. 22, 2005

(54) MOLTEN METAL PUMP SYSTEM

(75) Inventors: Ronald Gilbert, Liberty Lake, WA (US); Mark Palmer, Spokane, WA (US)

(73) Assignee: Pyrotek, Inc., Spokane, WA (US)

( * ) Notice: Subject to any disclaimer, the term of this patent is extended or adjusted under 35 U.S.C. 154(b) by 38 days.

(21) Appl. No.: 10/284,033

(22) Filed: Oct. 29, 2002

(65) Prior Publication Data

US 2004/0081555 A1 Apr. 29, 2004

(51) Int. Cl.[7] ..... F04D 7/06
(52) U.S. Cl. ..... 416/204 R; 415/200; 416/244 R
(58) Field of Search ..... 415/200, 214.1; 416/204 R, 244 R

(56) References Cited

U.S. PATENT DOCUMENTS 2,110,379 A * 3/1938 Lannert ..... 92/182
3,776,660 A * 12/1973 Anderson et al. ..... 415/200
6,451,247 B1 * 9/2002 Mordue et al. ..... 266/239
6,551,060 B2 * 4/2003 Mordue et al. ..... 415/216.1

* cited by examiner

*Primary Examiner*—F. Daniel Lopez
*Assistant Examiner*—Igor Kershteyn
(74) *Attorney, Agent, or Firm*—Wells St.John P.S.

(57) ABSTRACT

A molten metal pump system which generally provides a refractory connection joint for connecting a refractory pump post to a pump base, the pump post including a refractory post with a first end, the first end including an internally threaded joint screw aperture; a refractory base with a post aperture configured to receive the first end of the refractory post, and with a screw aperture contiguous with the post aperture; and a joint screw with a first end and a second end, the joint screw including a threaded external surface and a retention shoulder, the joint screw configured to insert through the screw aperture in the refractory base with the threaded external surface engaging the internally threaded joint screw aperture of the refractory post, and the retention shoulder engaging the refractory base.

11 Claims, 6 Drawing Sheets

MOLTEN METAL PUMP SYSTEM

CROSS REFERENCE TO RELATED APPLICATION

There are no applications related to this application or upon which priority is claimed.

TECHNICAL FIELD

This invention pertains to a molten metal pump system for use in pumping molten metal, and more particularly, to joints and connections used with molten metal pumps to avoid the need for cemented joints.

BACKGROUND OF THE INVENTION

Molten metal may be one of the more difficult environments in which to maintain a pump due to the heat and corrosive factors within the molten metal. The submerged components of these pumps are typically made of graphite, ceramics or similar materials due to the ability of these types of material compositions to withstand the heat and corrosive effects of the molten metal environment. While references may be made herein to molten aluminum, this is only used to give an example and not to limit the invention to aluminum pumps, since the pump systems disclosed herein may be used for pumping other molten metals.

Despite the positive properties for this application, graphite and ceramics still corrode and deteriorate over time, and molten metal pumps must be more frequently maintained and replaced than other types of pumps. The replacement or servicing of a pump operating submersed in molten metal is a time consuming exercise. First the pump must be removed from the molten metal which generally causes downtime of the metal furnace if that is the application. Then the pump along with the molten metal contained thereon must be allowed to sufficiently cool to allow it to be disassembled.

Once the deteriorated components are sufficiently cool, the molten metal built up on the various pump surfaces must be sufficiently removed to allow disassembly and/or re-use of the pump components. Then the pump must be reassembled with the combination of old components or parts, along with the replacement parts. The downtime of a molten metal pump may be as much as two to three days before it is operational again, which illustrates the importance of increasing the useful life of the pumps.

In the disassembly of the pump, there are certain components which are typically cemented together in order to achieve a balanced and sufficiently rigid pump structure to allow continuous operation of the pump. However, when the pump must be disassembled, those cemented joints can be very difficult to disassemble.

For instance, in the case of a pump with vertical posts between the pump base and the motor mount structure, the posts have traditionally been cemented into bored holes within the base. When the pump is disassembled, the cemented portion of the posts must normally then be chipped, dug or drilled out in order to allow a new post to be placed in the same bore. This makes the disassembly much more difficult when certain replacement parts are being placed back into other parts which have already been in operation.

The combination of configuration and the number of components of typical pump systems makes them difficult to efficiently, accurately and quickly reassemble them. It is important that the motor, shaft, pump base and output conduit body be accurately aligned in order for the pump system to work efficiently once it is back in the molten metal. In some prior art pump systems, special jigs or other apparatus must be used to align the motor mount framework, the pump base, the pump shaft and the output conduit body. The combination of the components are very heavy, and because there are as many as four components which must be accurately aligned and then secured to one another, substantial time must be taken to assemble the pump system in the precise manner required by the application. Hence the need for a jig to assemble some prior art pumps.

It is an object of this invention to provide a pump which does not require as many or any cemented joints as the prior art pumps. It is also an objective of some of the embodiments of this invention to provide a pump and assembly system which tends to self-align the pump during the assembly process due to its design and configuration, reducing or eliminating the need for a jig or other alignment apparatus in some embodiments of the invention.

BRIEF DESCRIPTION OF THE DRAWINGS

Preferred embodiments of the invention are described below with reference to the following accompanying drawings.

FIG. 14 is an elevation view of an embodiment of an exemplary support post which may be utilized in a pump and with which a cementless joint may be utilized, as contemplated by this invention;

FIG. 15 is section view AA from FIG. 14;

FIG. 16 is a top view of the exemplary post illustrated in FIG. 15; and

FIG. 17 is a bottom view of the exemplary post illustrated in FIG. 15.

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
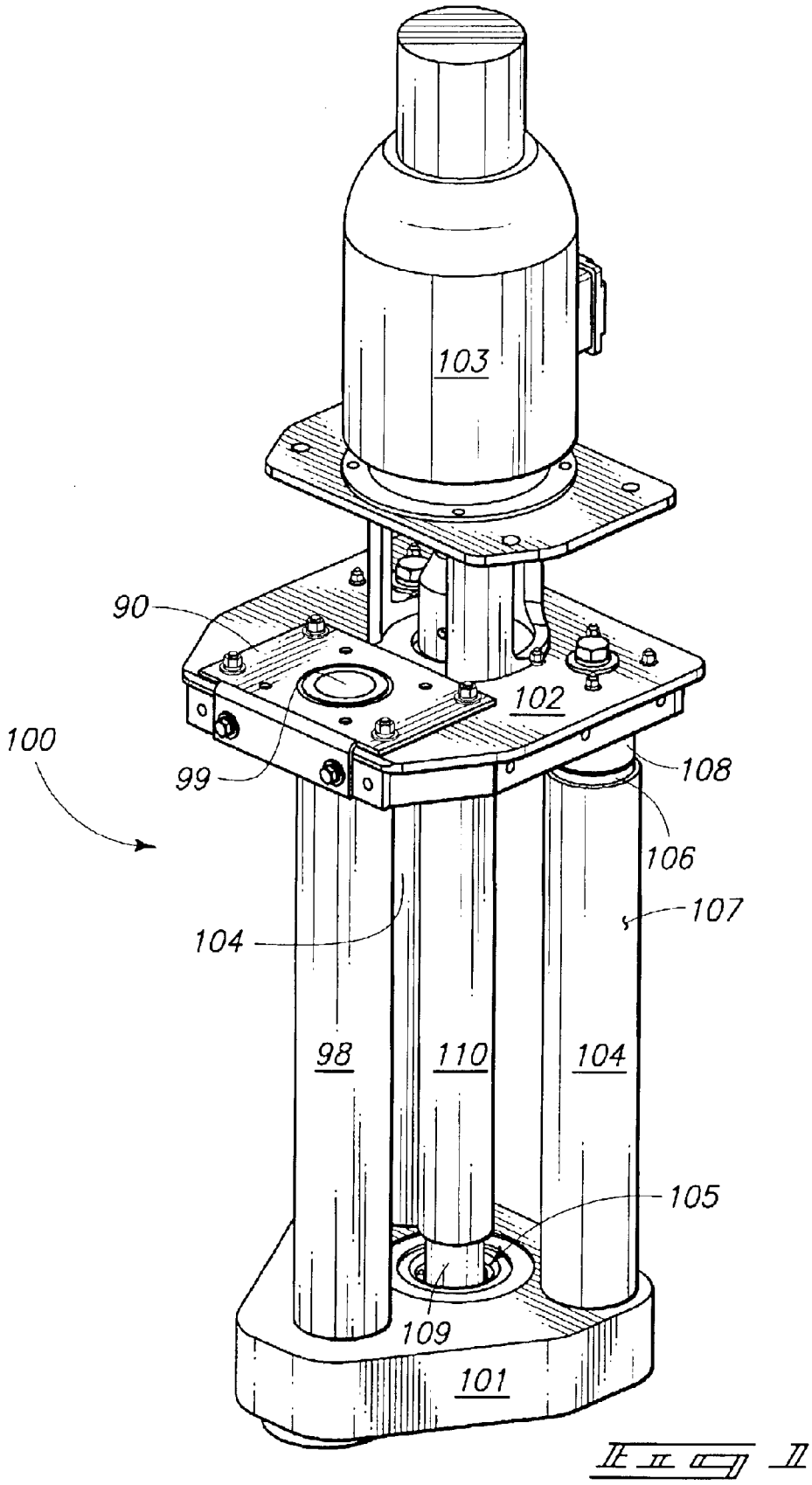
FIG. 1 is a perspective view of one embodiment of a molten metal pump system contemplated by this invention.

FIG. 1 is a perspective view of one embodiment of a molten metal pump system contemplated by this invention. FIG. 1 illustrates pump motor 103, pump motor base, pump motor mount 102, pump base 101, pump riser post 98, second pump post 104, refractory impeller shaft 109 with shaft insulation 110. FIG. 1 further illustrates a pump system embodiment 100 of this invention wherein pump post 104 exemplifies a standard pump post and refractory post 106. Pump post 104 is shown mounted to pump motor mount structure 102 via coupling 108. Pump riser post 98 includes an internal aperture 99 through which molten metal is pumped up from the pump base 101. Mount plate 90 secures and locates pump riser post 98 relative to pump motor mount structure 102.

Outer surface 107 may be the same or different material than shaft insulation 110.

Figure 2:
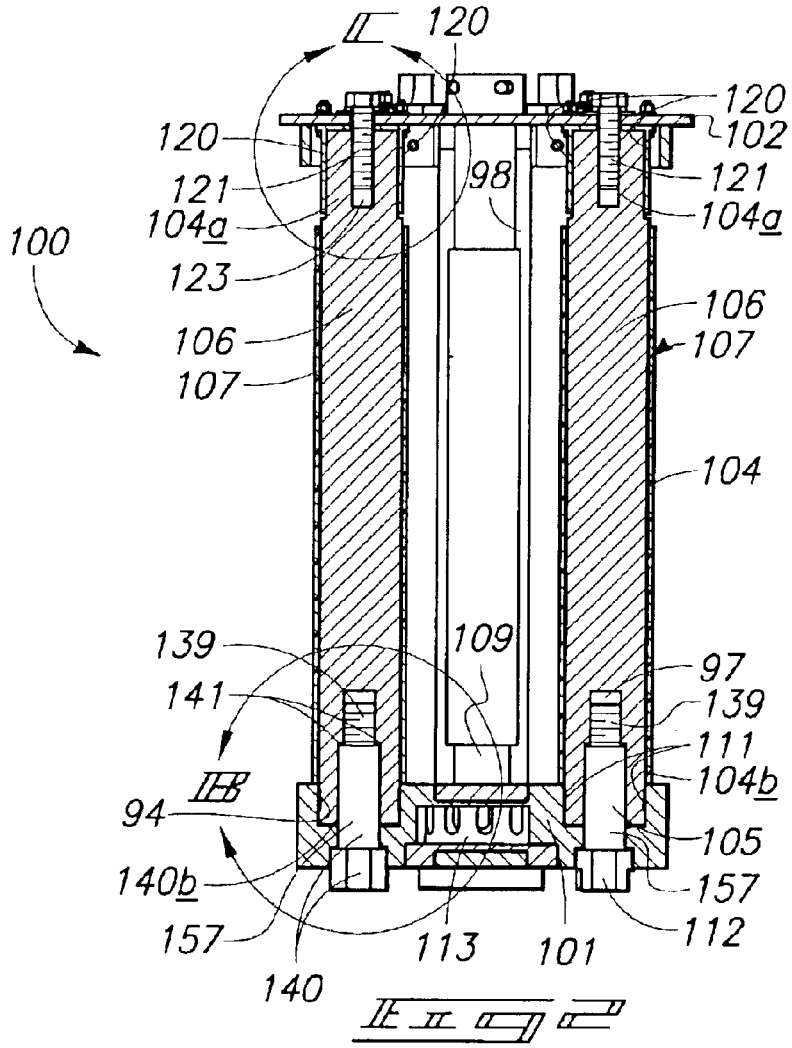
FIG. 2 is an elevation cross section view of the embodiment of the pump system illustrated in FIG. 1.

FIG. 2 is an elevation cross section view of the embodiment of the pump system illustrated in FIG. 1. FIG. 2 shows pump post 106 with post insulation 107 mounted to pump motor mount structure 102 via post mount couplings 120 and coupling screws 121. Coupling screws 121 are externally threaded and will be axially rotated to screw within upper post aperture 123 to draw post 106 into coupling 120 to locate it and secure it therein.

FIG. 2 also shows pump riser post 98 behind impeller shaft 109 and impeller insulation. Impeller shaft 109 is operably attached to pump impeller 113 as described in more detail in other later figures.

In turning attention to the joint connection at the lower end of the embodiment of the pump system illustrated in FIG. 2, pump posts 106 include internally threaded joint screw apertures 97 with shoulders 141 and joint screw 140 including screw head and external threads 139.

FIG. 2 also illustrates pump base 101, second joint screw 105 with joint screw head 112, and a refractory post seal which is illustrated as item 94 for joint screw 140 and item 111 for joint screw 105. A seal groove is located in the first end of the refractory posts and a seal is then placed in the seal groove to provide effective or desired sealing between refractory posts 106 and pump base 101, more particularly the post apertures in pump base 101. FIG. 2 shows a cross section of refractory posts 106 with outer surface 107 and outer portion 104.

Figure 3:
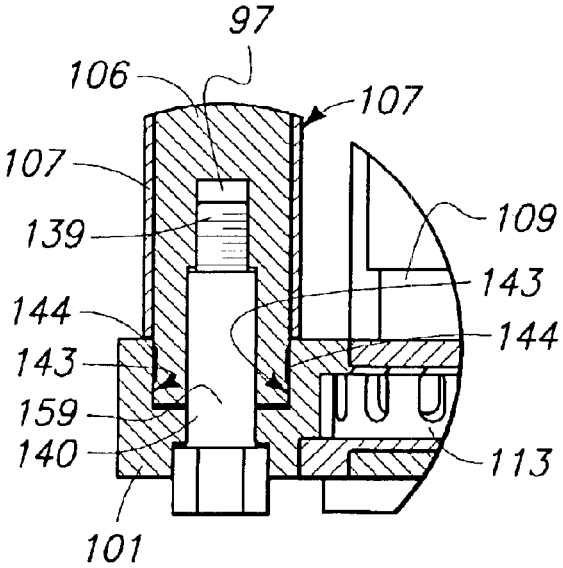
FIG. 3 is detail B within FIG. 2, illustrating an embodiment of a cementless pump joint.

FIG. 3 is detail B within FIG. 2, illustrating an embodiment of a cementless pump joint. FIG. 3 is detail B from FIG. 2, illustrates an embodiment of a joint connection contemplated by this invention, and shows joint screw 140 with first end 139 axially rotated via external screw threads into refractory post 106. Refractory post includes outer surface 107 and internally threaded joint screw aperture 97. Pump base 101 includes post aperture 143 sized and configured to preferably tightly receive refractory post 106. Refractory post 106 includes seal groove 144 around its perimeter, which is sized and configured to receive and retain a groove seal for providing effective sealing between refractory post 106 and pump base 101. Post aperture 143 in pump base 101 preferably provides tolerances sufficient to desirably locate refractory post 106. FIG. 3 also shows impeller 113 attached to impeller shaft 109 within pump base 101.

It will be appreciated by those of ordinary skill in the art that the connection joint illustrated in FIG. 3 does not require cement to form or secure the joint. Therefore a replacement post identical to refractory post 106 may be provided without the need to remove a cemented joint, but instead can be more easily removed and replaced.

Figure 4:
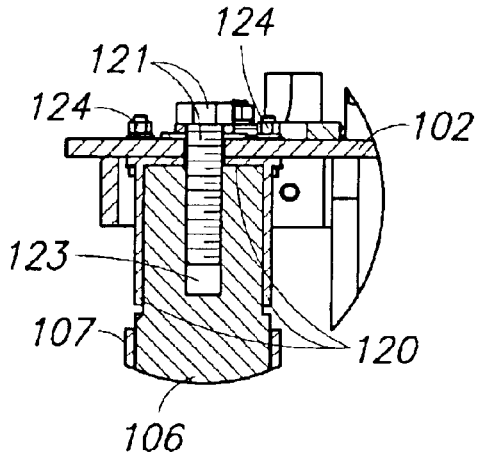
FIG. 4 is detail C from FIG. 2, illustrating a cementless attachment joint for attaching the top of the post to the motor mount framework.

FIG. 4 is detail C from FIG. 2, illustrating a cement-less attachment joint for attaching the top of the post to the motor mount framework and the upper coupling mechanism for coupling refractory post 106 to motor mount structure 102. FIG. 4 illustrates externally threaded coupling screw 121 within coupling screw aperture 123, nuts 124 securing bolts attached to coupling 120 to secure the coupling configuration to motor mount structure 102. Connection pin 121 may be utilized to draw, locate and/or position refractory post 106 within coupling 120, for secure upper attachment. Preferably, the coupling configuration illustrated in FIG. 4 provides very tight tolerances such that the combination of coupling shown in FIG. 4 and the joint connection shown in FIG. 3 does not require other jigs or equipment in order to align the pump during assembly and installation.

Figure 5:
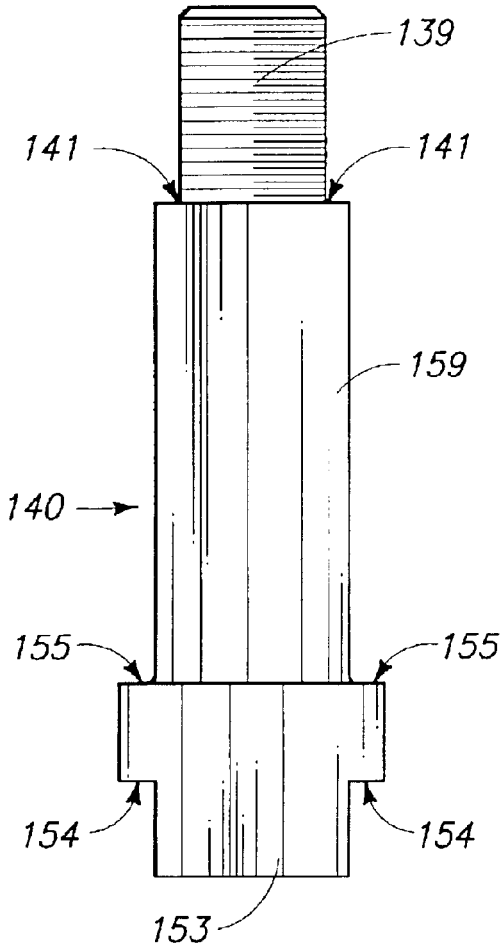
FIG. 5 is a front elevation view of an embodiment of a joint connector as contemplated by this invention.

FIG. 5 is a front elevation view of an embodiment of a joint connector as contemplated by this invention. FIG. 5 illustrates an embodiment of a joint screw which may be utilized in this invention. It should be noted that the joint screw illustrated includes a head 153, middle body portions 159 and a threaded portion 139, with a shoulder 141 transition between the middle body portion 159 and the threaded portion 139. A screw head shoulder 155 is also shown between middle body portion 159 and screw head 153, the screw head shoulder 155 providing an abutment surface for engagement with pump base 101 (not shown in FIG. 5). Slots 154 are cut into screw head 153 to allow a tool or other mechanism to engage screw head 153 to better facilitate axial rotation of the joint screw 140.

It will be appreciated by those of ordinary skill in the art that the middle portion 159 of the joint screw 140 inserts into a joint screw aperture in the post or impeller (whatever is applicable) and helps position the respective elements of the joint, namely the joint screw, the refractory post and the base. Middle portion 159 may further provide alignment benefits for the connection of refractory posts to bases.

It will further be appreciated by those of ordinary skill in the art that the refractory posts may either be pump posts or impeller shafts, the pump posts being preferably attached to pump base 101 and impeller shafts being preferably attached to impellers through the joint connection system provided by this invention.

Figure 6:
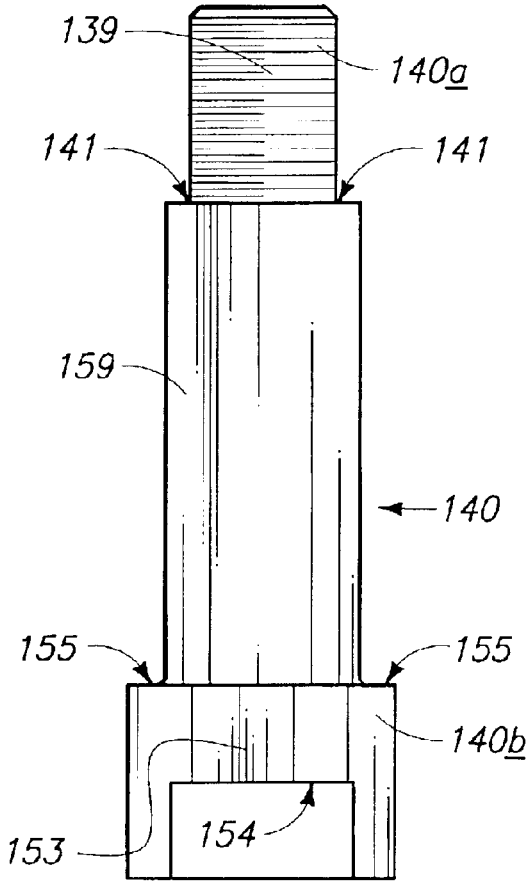
FIG. 6 is a side elevation view of the joint connector illustrated in FIG. 5.

FIG. 6 is a side elevation view of the joint connector illustrated in FIG. 5 and all similarly numbered items or reference numbers apply the same to the items referenced with respect to FIG. 5 and will not therefore be repeated herein. FIG. 6 also illustrates first end 140*a* and second end 140*b* of the joint screw 140.

Figure 7:
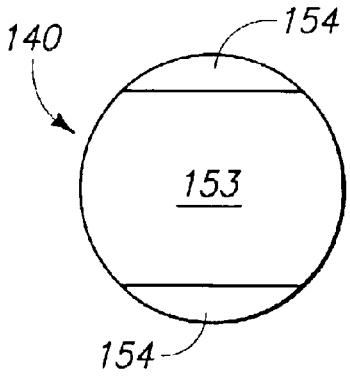
FIG. 7 is a bottom view of the embodiment of the joint connector illustrated in FIGS. 5 and 6.

FIG. 7 is a bottom view of the embodiment of the joint connector illustrated in FIGS. 5 and 6. FIG. 7 illustrates joint screw head 153 and slots 154 for joint screw 140.

Figure 8:
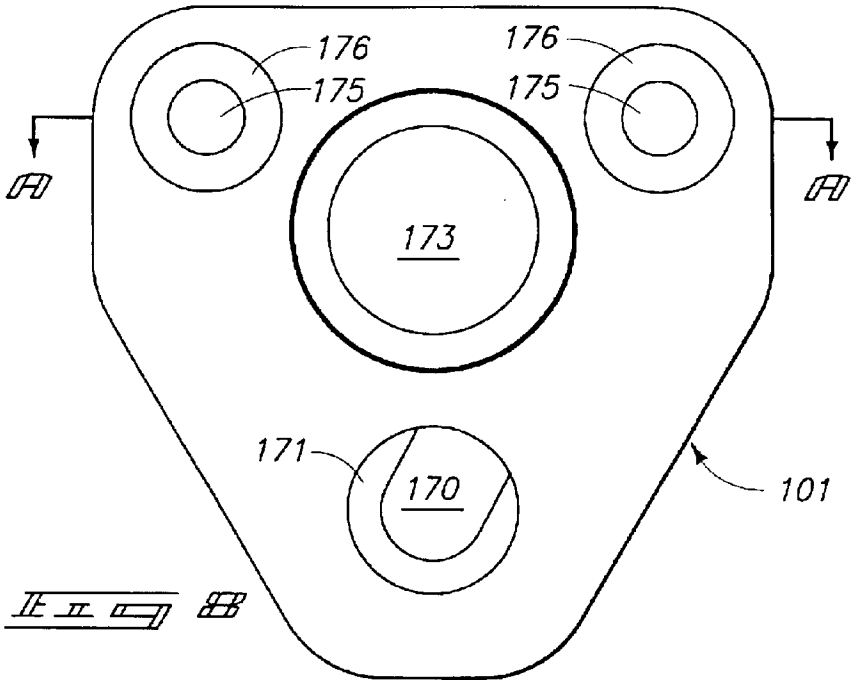
FIG. 8 is a top view of an exemplary pump base which may be utilized with this invention.

FIG. 8 is a top view of an exemplary pump base which may be utilized with this invention. FIG. 8 illustrates an exemplary pump base 101, which is made of refractory material and includes post apertures 176 and joint screw aperture 175. Impeller aperture 173 is shown, as is metal flow aperture 170 and pump base volute 171.

Figure 9:
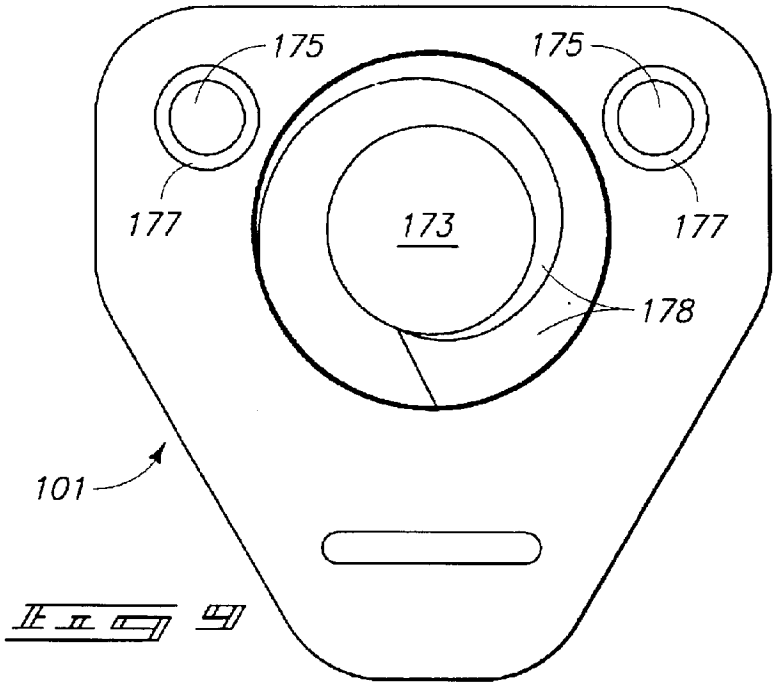
FIG. 9 is a bottom view of a pump base which may be utilized with this invention, and is also shown in FIG. 8.

FIG. 9 is a bottom view of a pump base which may be utilized with this invention, and is also shown in FIG. 8. FIG. 9 illustrates pump base 101, impeller aperture 173, portions of pump vollute 178 and joint screw shoulder 177 for abutting against joint screw shoulder 155 (FIG. 6) on joint screw 140.

Figure 10:
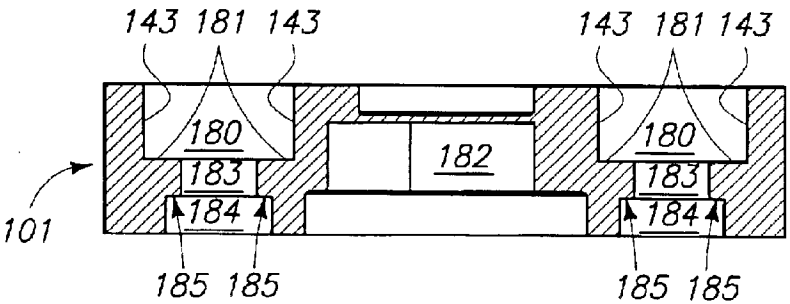
FIG. 10 is section view AA from FIG. 8.

FIG. 10 is section view AA from FIG. 8 and illustrates pump base 101 with impeller housing 182, post apertures 180 with shoulders 181 and side walls 143, joint screw aperture 183 contiguous to post aperture 180 and joint screw head aperture 184 with joint screw shoulders 185 (which are similar to joint screw shoulders 177 in FIG. 9).

The configuration in FIG. 10 would receive a joint screw from the lower side, and the head of the joint screw would insert into aperture 184 and shoulders 185 would abut joint screw shoulders 155 (as shown in FIG. 6) to provide a base against which the rotation will cause engagement of external threads on joint screw with internal threads in the pump post aperture.

Figure 11:
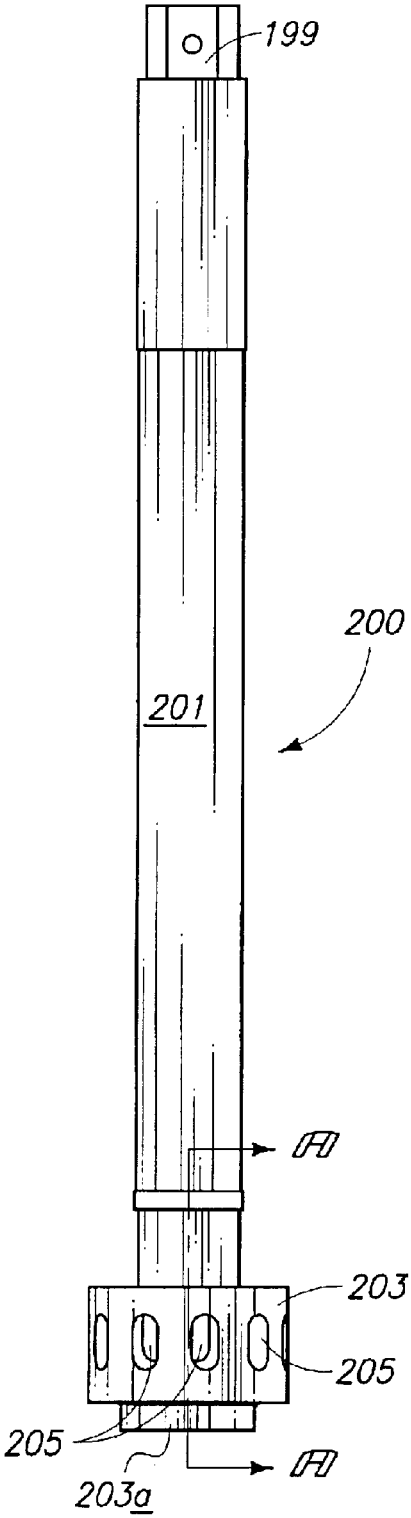
FIG. 11 is an elevation view of an impeller and shaft configuration utilizing a joint connector without cement.

FIG. 11 is an elevation view of an impeller and shaft configuration utilizing a joint connector without cement. FIG. 11 illustrates a joint connection which would include an impeller shaft 200 and pump impeller 203. Impeller shaft 200 includes outer surface 201 and first end 199 for operatively attaching the impeller shaft to the pump motor. Impeller 203 also includes impeller apertures 205 through which metal is pumped, and impeller base 203*a*.

Figure 12:
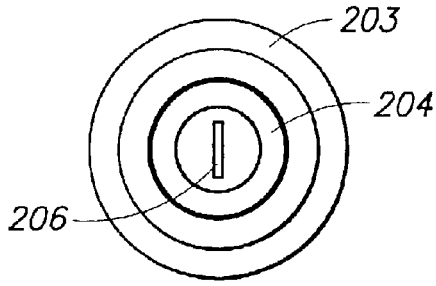
FIG. 12 is a bottom view of the impeller and joint connection illustrated in FIG. 11.

FIG. 12 is a bottom view of the impeller and joint connection illustrated in FIG. 11. FIG. 12 illustrates impeller 203 and impeller base 203*a* (FIG. 13), impeller joint screw 204 with joint screw key 206.

Figure 13:
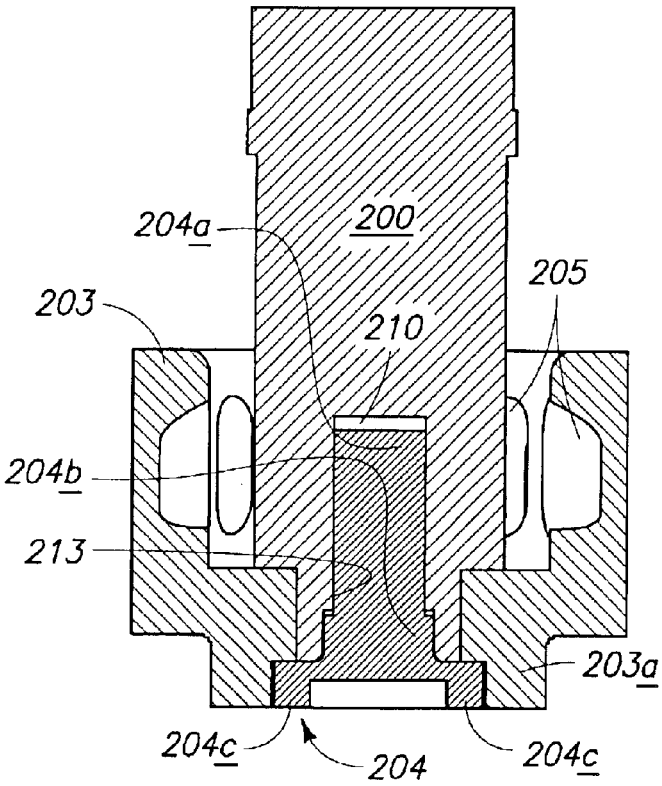
FIG. 13 is section AA from FIG. 11.
Figure 11A:
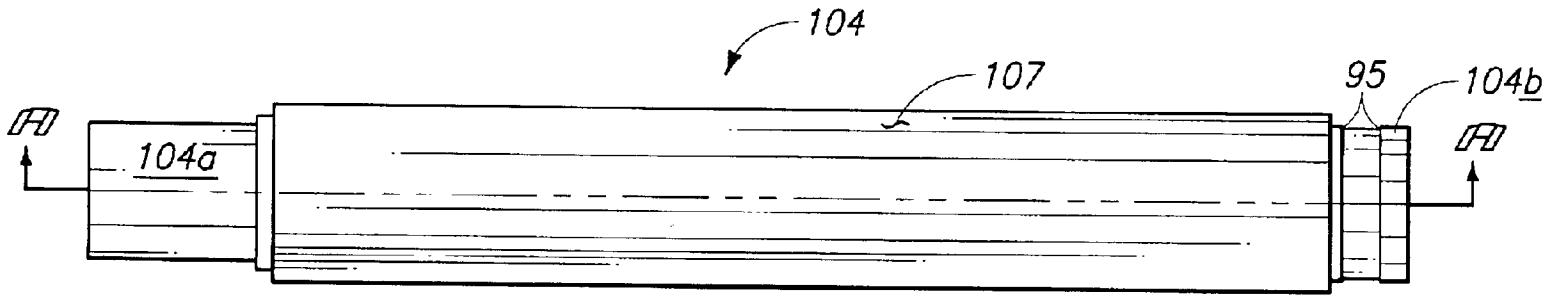
Figure 11B:
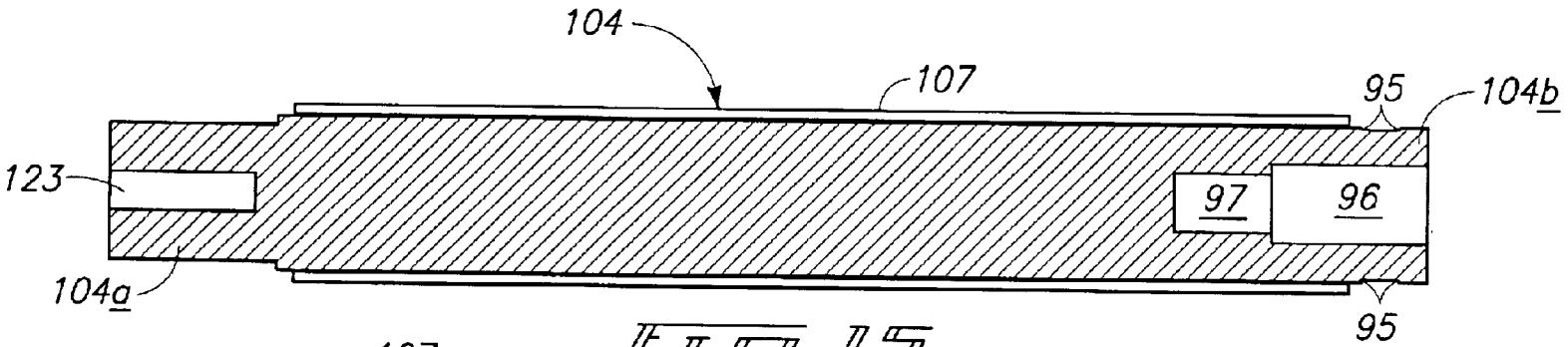
Figure 11C:
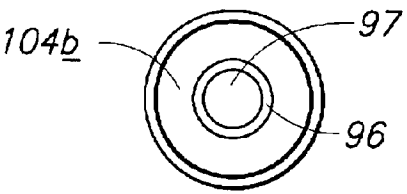
Figure 11D:
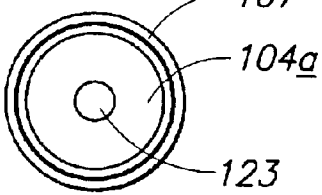

FIG. 13 is section AA from FIG. 11 and illustrates impeller joint screw 204 with impeller joint screw head 204*c*, intermediate portion 204*b* and threaded portion 204*a*. The impeller joint screw 204 is axially rotated to insert it within impeller shaft 200 with the threaded portion securing the impeller joint screw to the impeller shaft 200 and drawing the shaft together with the impeller 203. Impeller joint screw aperture 213 in impeller shaft 200 receives the externally threaded portion of impeller joint screw 204. The intermediate portion 204*b* of impeller joint screw 204 need not be externally threaded and may provide locating and alignment features if sufficiently minimal tolerances are achieved between it and the aperture in impeller shaft 200.

FIG. 13 further illustrates impeller apertures 205 within impeller 203, through which metal is pumped when the impeller rotates.

FIG. 14 is an elevation view of an embodiment of an exemplary support post which may be utilized in a pump and with which a cement-less joint may be utilized, as contemplated by this invention. FIG. 14 illustrates one embodiment of a placement refractory post which may be utilized in this invention, showing refractory post 104 with second end 104*a* and first end 104*b*, outer surface 107 and seal groove 95 in first end 104*b* of refractory post 104. The seal groove 95 is cut to allow a seal to effectively be placed between the refractory post and the post aperture in a refractory base into which the post 104 may be inserted.

FIG. 15 is section view AA from FIG. 14 and illustrates coupling screw aperture 123, outer surface 107, seal groove 95 in refractory post 104. At first end 104*b* of refractory post 104, joint screw aperture includes two portions, namely a first portion 96 to receive the intermediate portion of the joint screw and a second portion 97 to receive the externally threaded portion of the joint screw. The inner surface of portion 96 would be smooth and if close tolerances are observed, the combination of the aperture and the intermediate portion of the joint screw may be used for alignment and location purposes of the refractory post 104 into the refractory base. The internal threads in aperture portion 97 will correspond to the external threads on the threaded portion of a joint screw which may be inserted into the aperture and serves to locate, engage and secure refractory post 104 to a refractory base.

FIG. 16 is a top view of the exemplary post illustrated in FIGS. 14 and 15. FIG. 16 illustrates second end 104*a* of refractory post 104 (shown in FIG. 15), coupling screw aperture 123 and outer surface 107.

FIG. 17 is a bottom view of the exemplary post illustrated in FIGS. 14 and 15. FIG. 17 illustrates first end 104*b* of refractory post 104 (shown in FIG. 15), first portion 96 of joint screw aperture and second portion 97 of joint screw aperture configured to receive a joint screw.

As will be appreciated by those of reasonable skill in the art, there are numerous embodiments to this invention, and variations of elements and components which may be used, all within the scope of this invention.

One embodiment of this invention, for example, is a molten metal pump refractory connection joint, comprising: a refractory post with a first end, the first end including an internally threaded joint screw aperture; a refractory base with a post aperture configured to receive the first end of the refractory post, and with a screw aperture contiguous with the post aperture; and a joint screw with a first end and a second end, the joint screw including a threaded external surface and a retention shoulder, the joint screw configured to insert through the screw aperture in the refractory base with the threaded external surface engaging the internally threaded joint screw aperture of the refractory post, and the retention shoulder engaging the refractory base. Further embodiments of the foregoing may be: further wherein the first end of the refractory post includes a seal groove around an outer surface; and a refractory post seal seated within the seal groove around the first end of the refractory post, such that the post seal provides a molten metal seal between the outer surface of the post and an inner surface of the post aperture wherein the refractory post is an impeller shaft and the refractory base is a molten metal pump impeller; and/or further wherein the refractory post is a molten metal pump post and the refractory base is a molten metal pump base.

In another embodiment of the invention, a molten metal pump replacement post and joint screw combination is provided for use in a refractory connection joint which includes a refractory base with a post aperture on a first side and a screw aperture on a second side of the refractory base, the screw aperture being contiguous with the post aperture, the replacement post and joint screw comprising: a refractory replacement post with a first end, the first end including an internally threaded joint screw aperture and an outer surface configured to insert into the post aperture in the refractory base; and a replacement joint screw with a first end and a second end, the joint screw including a threaded external surface and a retention shoulder, the joint screw configured to insert through the screw aperture in the refractory base with the threaded external surface configured to threadingly engage the internally threaded joint screw aperture of the replacement post, and the retention shoulder configured to engage the base. Further embodiments of the foregoing may be: further wherein the refractory post is an impeller shaft and the refractory base is a molten metal pump impeller; further wherein the refractory post is a molten metal pump post and the refractory base is a molten metal pump base; and/or further wherein the first end of the refractory post includes a seal groove around an outer surface configured to receive and a refractory post seal (which may still further comprise a post seal lodged in the seal groove around the outer surface of the refractory post).

In another embodiment of this invention, a molten metal pump system is provided which comprises: a pump motor mounted to a mount structure, the mount structure including a shaft aperture; an impeller shaft with a first end operatively attached to the pump motor and a second end mounted to a pump impeller, the impeller shaft being positioned within the shaft aperture of the mount structure; a pump base; a plurality of pump posts each with a first end attached to the mount structure and each with a second end attached to the pump base via a refractory connection joint, the refractory connection joint comprising: the first end of the pump post with an internally threaded aperture; a post aperture in the pump base, the post aperture configured to receive the first end of the pump post, the pump base further including a screw aperture contiguous with the post aperture; and a joint screw with a first end and a second end, the joint screw including a threaded external surface and a retention shoulder, the joint screw configured to insert through the screw aperture in the pump base, and with the threaded external surface of the joint screw engaging the internally threaded joint screw aperture of the pump post, and the retention shoulder engaging the pump base.

There are also process embodiments of this invention, one embodiment of which may be a method for assembling a molten metal pump refractory connection joint comprising the following: providing a refractory post with a first end, the first end including an internally threaded joint screw aperture; providing a refractory base with a post aperture configured to receive the first end of the refractory post, and with a screw aperture contiguous with the post aperture; providing a joint screw with a first end and a second end, the joint screw including a threaded external surface and a retention shoulder; inserting the joint screw through the screw aperture in the refractory base; axially rotating the joint screw such that the threaded external surface engages the internally threaded joint screw aperture of the refractory post, and further such that the retention shoulder engages the refractory base; and continuing to rotate the joint screw until the post is securely drawn into the post aperture.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A molten metal pump refractory connection joint, comprising:

a refractory post with a first end, the first end including an internally threaded joint screw aperture;

a refractory base with a post aperture configured to receive the first end of the refractory post, and with a screw aperture contiguous with the post aperture; and a joint screw with a first end and a second end, the joint screw including a threaded external surface and a retention shoulder, the joint screw configured to insert through the screw aperture in the refractory base with the threaded external surface engaging the internally threaded joint screw aperture of the refractory post, and the retention shoulder engaging the refractory base.

2. A molten metal pump refractory connection joint as recited in claim 1, and further wherein the first end of the refractory post includes a seal groove around an outer surface; and a refractory post seal seated within the seal groove around the first end of the refractory post, such that the post seal provides a molten metal seal between the outer surface of the post and an inner surface of the post aperture.

3. A molten metal pump refractory connection joint as recited in claim 1, and further wherein the refractory post is an impeller shaft and the refractory base is a molten metal pump impeller.

4. A molten metal pump refractory connection joint as recited in claim 1, and further wherein the refractory post is a molten metal pump post and the refractory base is a molten metal pump base.

5. A molten metal pump replacement post and joint screw combination for use in a refractory connection joint which includes a refractory base with a post aperture on a first side and a screw aperture on a second side of the refractory base, the screw aperture being contiguous with the post aperture, the replacement post and joint screw comprising:

a refractory replacement post with a first end, the first end including an internally threaded joint screw aperture and an outer surface configured to insert into the post aperture in the refractory base; and a replacement joint screw with a first end and a second end, the joint screw including a threaded external surface and a retention shoulder, the joint screw configured to insert through the screw aperture in the refractory base with the threaded external surface configured to threadingly engage the internally threaded joint screw aperture of the replacement post, and the retention shoulder configured to engage the base.

6. A molten metal pump replacement post and joint screw combination as recited in claim 5, and further wherein the first end of the refractory post includes a seal groove around an outer surface configured to receive and a refractory post seal.

7. A molten metal pump replacement post and joint screw combination as recited in claim 6, and further comprising a post seal lodged in the seal groove around the outer surface of the refractory post.

8. A molten metal pump replacement post and joint screw combination as recited in claim 5, and further wherein the refractory post is an impeller shaft and the refractory base is a molten metal pump impeller.

9. A molten metal pump replacement post and joint screw combination as recited in claim 5, and further wherein the refractory post is a molten metal pump post and the refractory base is a molten metal pump base.

10. A molten metal pump system comprising:

a pump motor mounted to a mount structure, the mount structure including a shaft aperture;

an impeller shaft with a first end operatively attached to the pump motor and a second end mounted to a pump impeller, the impeller shaft being positioned within the shaft aperture of the mount structure;

a pump base;

a plurality of pump posts each with a first end attached to the mount structure and each with a second end attached to the pump base via a refractory connection joint, the refractory connection joint comprising:

the first end of the pump post with an internally threaded aperture;

a post aperture in the pump base, the post aperture configured to receive the first end of the pump post, the pump base further including a screw aperture contiguous with the post aperture; and a joint screw with a first end and a second end, the joint screw including a threaded external surface and a retention shoulder, the joint screw configured to insert through the screw aperture in the pump base, and with the threaded external surface of the joint screw engaging the internally threaded joint screw aperture of the pump post, and the retention shoulder engaging the pump base.

11. A method for assembling a molten metal pump refractory connection joint comprising the following:

providing a refractory post with a first end, the first end including an internally threaded joint screw aperture;

providing a refractory base with a post aperture configured to receive the first end of the refractory post, and with a screw aperture contiguous with the post aperture;

providing a joint screw with a first end and a second end, the joint screw including a threaded external surface and a retention shoulder;

inserting the joint screw through the screw aperture in the refractory base;

axially rotating the joint screw such that the threaded external surface engages the internally threaded joint screw aperture of the refractory post, and further such that the retention shoulder engages the refractory base; and continuing to rotate the joint screw until the post is securely drawn into the post aperture.

* * * * *